US005326005A

United States Patent [19]

Fisher

[11] Patent Number: 5,326,005

[45] Date of Patent: Jul. 5, 1994

[54] BALL HOLSTER

[76] Inventor: Gary L. Fisher, 10309 Bel-Aire, Dallas, Tex. 75218

[21] Appl. No.: 1,628

[22] Filed: Jan. 7, 1993

[51] Int. Cl.[5] ..... A45F 5/00

[52] U.S. Cl. ..... 224/253; 224/226; 224/245; 224/901; 224/919

[58] Field of Search ..... 224/253, 252, 224, 226, 224/901, 919, 227, 271, 272, 197, 199, 242, 245

[56] References Cited

U.S. PATENT DOCUMENTS

| | | | |
|---|---|---|---|
| 2,500,257 | 3/1950 | Mahan | 224/251 |
| 4,072,256 | 2/1978 | Young . | |
| 4,256,244 | 3/1981 | Gasper . | |
| 4,433,803 | 2/1984 | Liberboim . | |
| 4,986,459 | 1/1991 | Yarbrough, Jr. | 224/253 |
| 5,065,107 | 11/1991 | Ascarranz . | |

*Primary Examiner*—Linda J. Sholl

[57] ABSTRACT

A ball carrying device for the storage and removal of game balls particularly, tennis balls. The device includes a body (11) of leather formed into a U-shape with a front fold (12). The body (11) is closed along the rear upper portion (11A) by securing a divider panel (13) which then extends inside the body (11) and attaches behind the front fold (12). The divider panel (13) will divide the body (11) into an upper ball recess (14) with a top opening (15) and a lower ball recess (16) with a rear opening (17) for insertion and removal of bals from the top and rear. The lower ball recess (16) is closed on the bottom by a bottom panel (11B). An upper spacer (18) is secured through the center of the upper ball recess (14) and a lower spacer (19) is secured through the center of the lower ball recess (16) to give the center of the respective ball recess (14) and (16) a dimension slightly less than that of the ball. Two pieces of hooked fastening material (20) are secured inside the body (11) for each of the majority of balls in the upper ball recess (14) and each ball in the lower ball recess (16) to retain the balls inside the body (11). A belt loop assembly (24), leg strap loop (27) and leg strap (28) are provided for attaching the device to a player.

4 Claims, 7 Drawing Sheets

BALL HOLSTER

BACKGROUND OF THE INVENTION

The present invention relates to ball carrying devices for storing and removing game balls, particularly tennis balls.

The need to store and retrieve tennis balls while retaining freedom of movement is a concern to the tennis player. The player's pant pockets are commonly used to carry balls. This practice can be undesirable due to the fact that most pant pockets were not designed to allow a desired number of balls to be carried comfortably.

Varying types of tennis ball carriers, worn about the player's waist, have been proposed. Some of these designs are, a rigid tubular section with the ball being compressed for storage, a belt with a plurality of single pockets to store balls, and a clip-on ball holder for a single ball. Previous ball carrying devices have stopped short of providing a distinct attractive design which would substantially enhance salability.

The limited number of tennis ball carrying devices for sale in the United States is a good example that prior ball carrying devices have failed to totally meet the needs of the tennis player and accordingly, failed to get support from the manufacturing community.

The current invention, a ball holster, worn on the player's hip opposite the racquet hand, will prove to be not only functional, but contain definite aesthetic qualities that would be of superior value and have greater marketability than previous tennis ball carrying devices.

SUMMARY OF THE INVENTION

An object of the present invention is to provide a ball holster for storing and removing tennis balls, and the like, which provides:

(a) an upper and lower ball recess with a combined capacity of five tennis balls;

(b) the upper and lower ball recess with a top and rear opening respectively;

(c) an effective securing means to retain the balls in the holster during extreme physical activity;

(d) securing to a convenient area of the player which will not restrict movement;

(e) a distinct visual appeal to the prospective buyer;

(f) a design that may be easily and efficiently manufactured;

(g) durable and reliable construction.

All is accomplished in a ball holster comprising a body of leather material folded at the front and closed around the rear upper portion of the body by securing one end of a divider panel. The other end of the divider panel extends inside the body and is secured behind the front fold. This will divide the body into an upper ball recess with a top opening and a lower ball recess with a rear opening. The lower ball recess is closed on the bottom by a bottom panel secured to the bottom edges of the body.

In the preferred embodiment, to further form a pocket for the tennis balls, a spacer is secured through the center of each ball recess. The spacer is an adjusting means to give the center of the upper and lower ball recess a dimension slightly less than the diameter of the ball.

To retain the balls inside each ball recess, a ¾ inch square piece of hooked fastening material is attached to the exact point where the ball touches the sides of the recess.

The tennis ball's nap will act as a looped fastening material when in contact with the hooked fastening material, forming a bond that will retain the balls in the holster during extreme player movement.

The invention includes a means for attaching to the player. A belt loop assembly is provided which will accept various sized belts for securing the ball holster to a player's waist. A leg strap loop and leg strap is included to secure the bottom of the ball holster to the player's leg.

The right handed player would wear the ball holster on the left hip area giving the player quick and easy visual and physical access to the balls.

For storage, a ball can be slipped into the respective ball recess through the top or rear opening which causes the body of leather material to expand and cradle the ball. The ball contact with the hooked fastening material will retain the ball in the ball holster.

To remove a ball, the thumb is inserted into either ball recess applying an outward pressure on the ball, releasing it from the recess.

Further objects and advantages of the invention will become apparent from a consideration of the drawings and ensuing description of it.

THE DESCRIPTION OF THE PREFERRED EMBODIMENT

Figure 1:
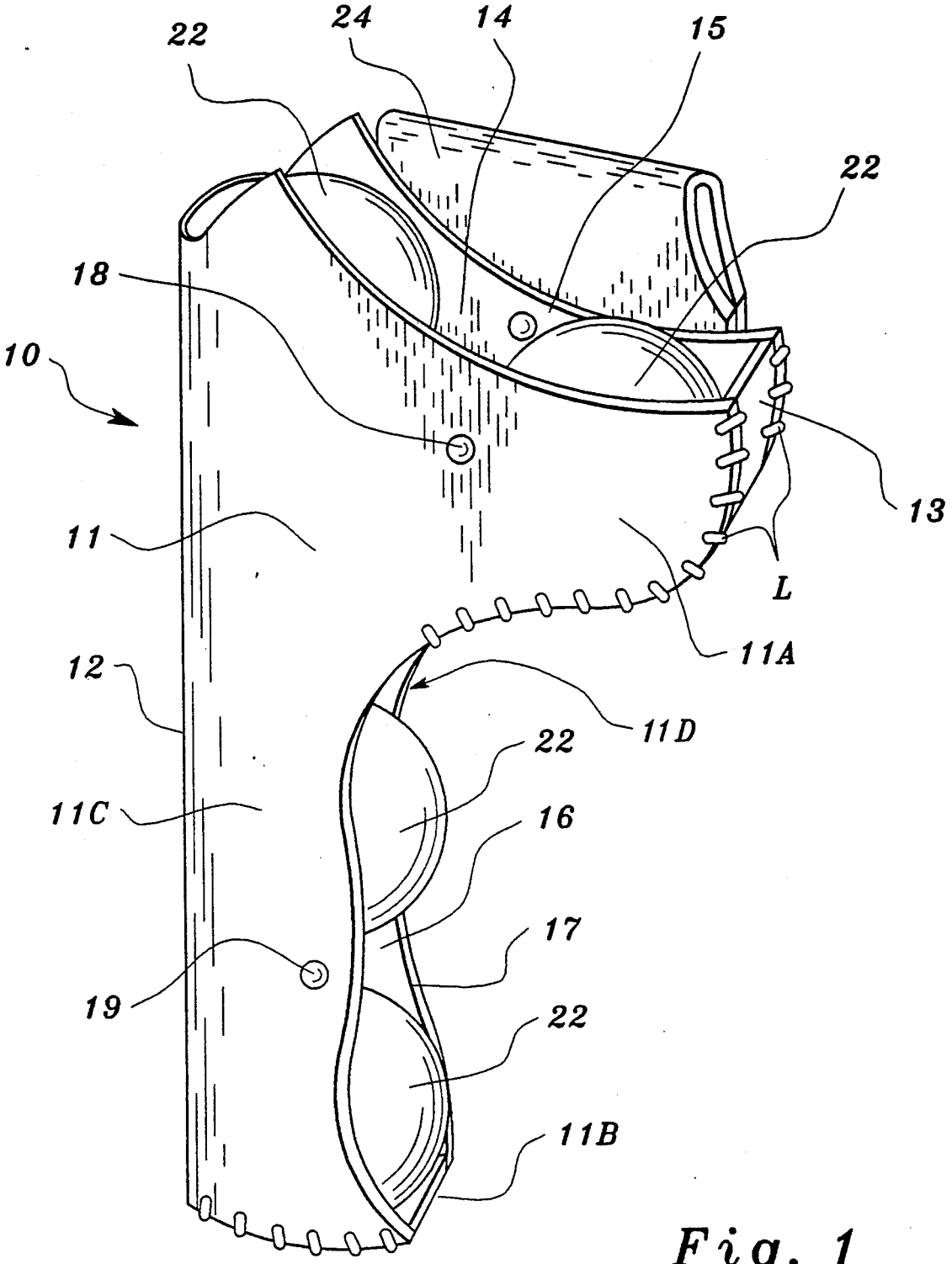
FIG. 1 is a perspective view of a ball holster of the present invention.

The general appearance of the preferred embodiment of this invention may be seen in FIG. 1 as a ball holster 10 including a body portion 11 produced from a piece of leather or leather like material which is formed into a U shape with a front fold 12. The body 11 is of sufficient size to accommodate five balls 22.

Figure 2:
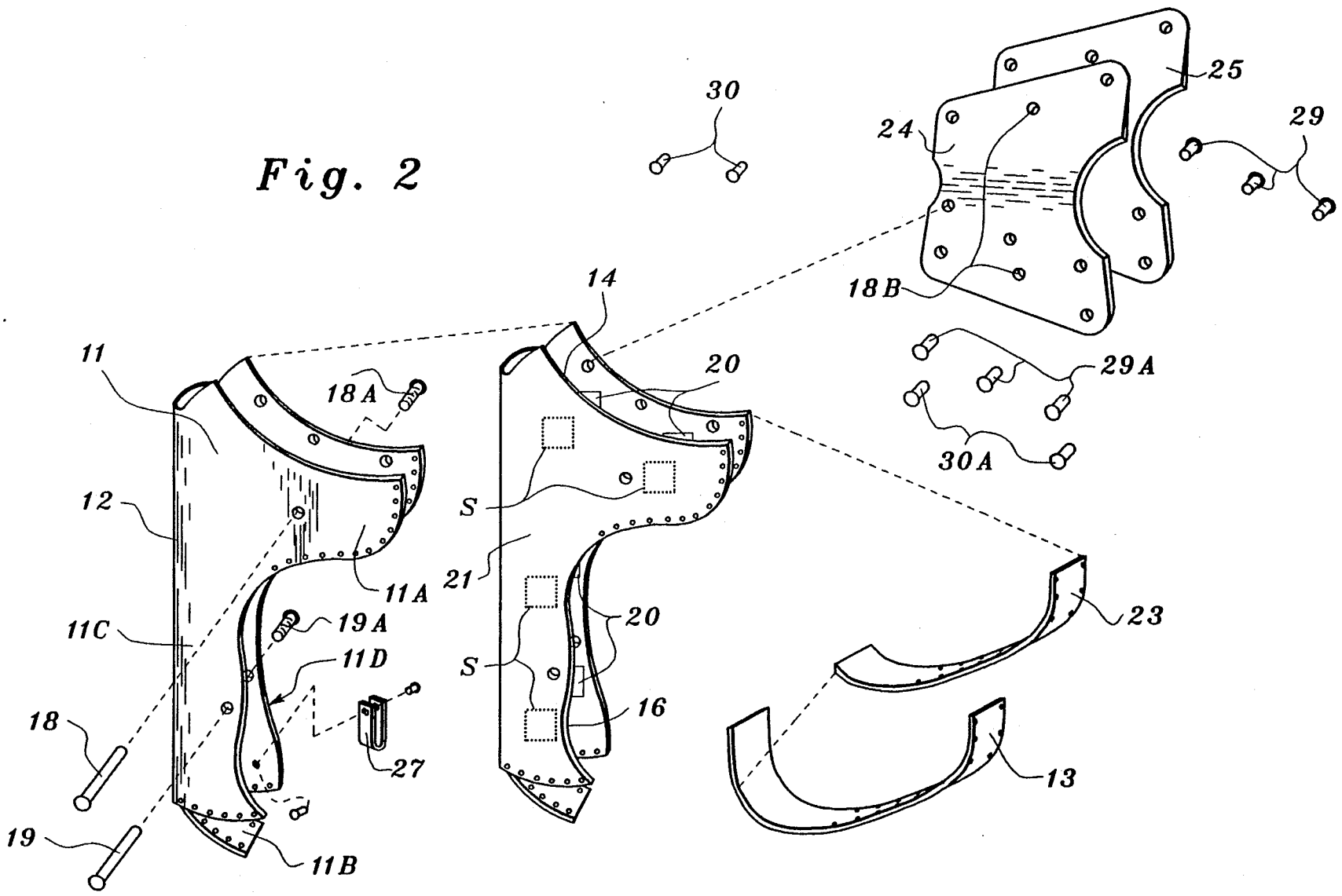
FIG. 2 is an exploded view of the present invention.

In FIG. 2, which is an exploded view of the ball holster 10, the body 11 of the ball carrying device in this embodiment is shown as including a body liner 21, produced from material like that of the body 11, to achieve a desired thickness of material and provide a finished surface to both sides of the body 11.

Figure 3:
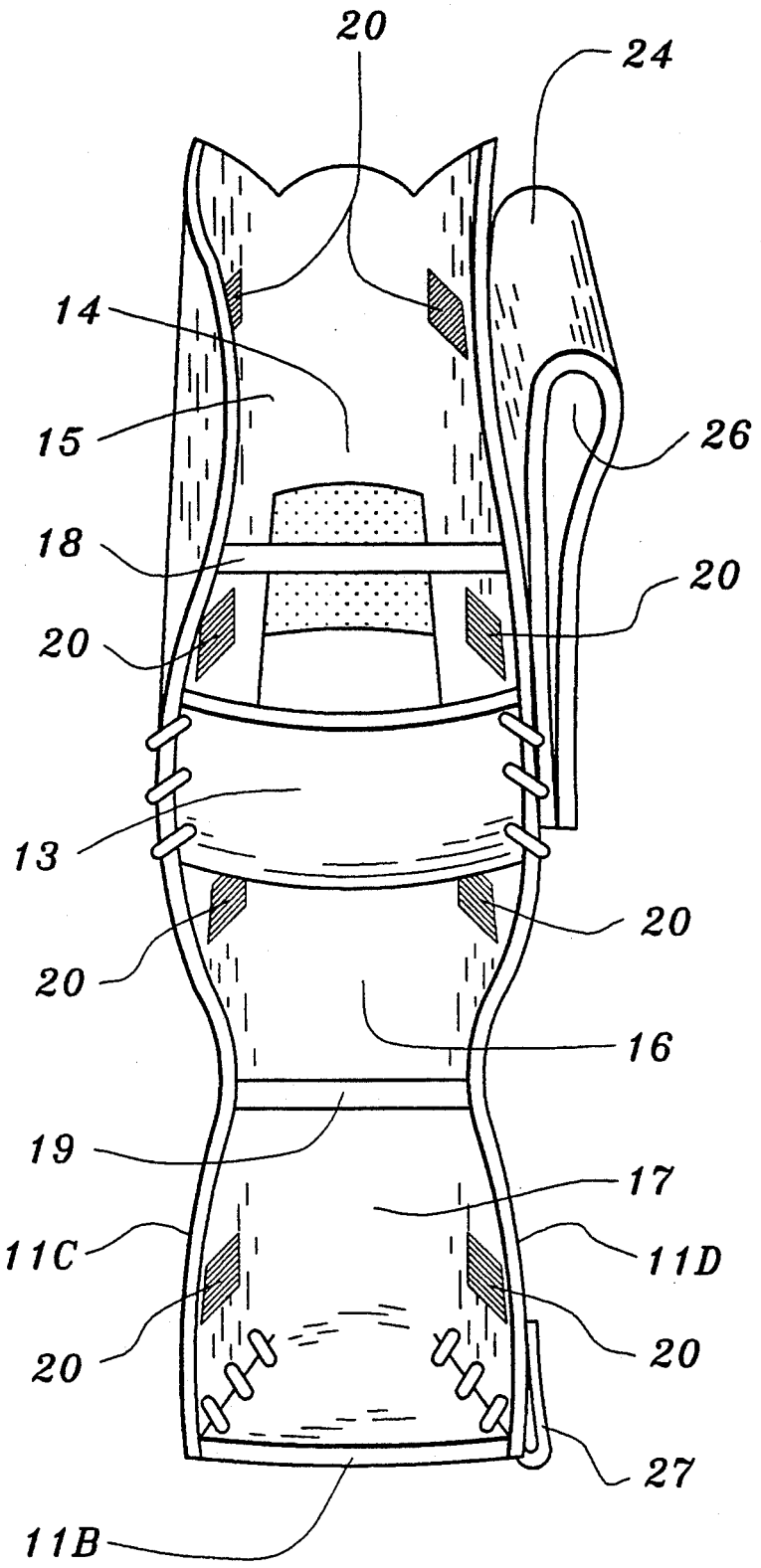
FIG. 3 is a rear elevational view of the holster of FIG. 1 showing the inside of the ball recesses.

Referring to FIGS. 1, 2, and 3, one may see a divider panel 13, including a divider panel liner 23, both produced from a piece of leather or leather like material. Like the body liner 21, the divider panel liner 23 is utilized to achieve a desired thickness of material and provide a finished surface to both sides of the divider panel 13. The divider panel 13, is the same width as the diameter of the ball 22 which is approximately 2½ inches. The body 11 is closed along its rear upper portion 11A by joining the divider panel 13. The divider panel 13 then extends inside the body 11 where it is joined, as by cementing, to the body liner 21 behind the front fold 12. The divider panel 13, as its name implies, will divide the body 11 into an upper ball recess 14 with a top opening 15 and a lower ball recess 16 with a rear opening 17 to allow insertion and removal of balls 22 from the top and rear. The divider panel 13 also serves as the bottom of the upper ball recess 14.

The lower ball recess 16 is closed on the bottom by a bottom panel 11B, which is an integral part of the body 11, by securing along the bottom edges of the body 11. The width of the bottom panel 11B is 2¼ inches which is slightly smaller that the diameter of the ball 22.

Looking now to FIGS. 1 and 3, a first spacer 18 and a second spacer 19, such as threaded post rivets, were needed to adjust the center of the upper ball recess 14 and lower ball recess 16 to a dimension slightly less than the diameter of the ball 22 to allow the body 11 to conform to the ball upon insertion and removal. The first spacer 18 is secured through the center of the upper ball recess 14 and the second spacer 19 is secured through the center of the lower ball recess 16. It was discovered a 3/16"×2" aluminum threaded post rivet employed as spacers 18 and 19 would give the desired dimension to the center of each ball recess and required no special manufacturing since the threaded post rivet is available at most hardware stores.

Another element, working with the spaces as a means for retaining balls 22 in the ball holster 10, may be seen in FIG. 3 as a hooked fastening material 20. A ¾ inch square piece of hooked fastening material 20 is secured to the body liner 21 inside the upper ball recess 14 and lower ball recess 16 where the sides of the fully inserted balls touch the sides of the respective recess. Two pieces of hooked fastening material 20 are applied to retain each of the majority of balls in the upper ball recess 14, and each ball in the lower ball recess 16. Through experimentation it was found that ball 31, in FIG. 4 was deep enough in the upper ball recess 14 that the body 11 and front fold 12 would retain ball 31 without the use of the hooked fastening material 20. The ball's nap will act as a looped fastening material when in contact with the hooked fastening material 20 forming a bond, and in conjunction with spacers 18 and 19 will retain the balls in the ball holster 10 until they are needed.

Figure 5:
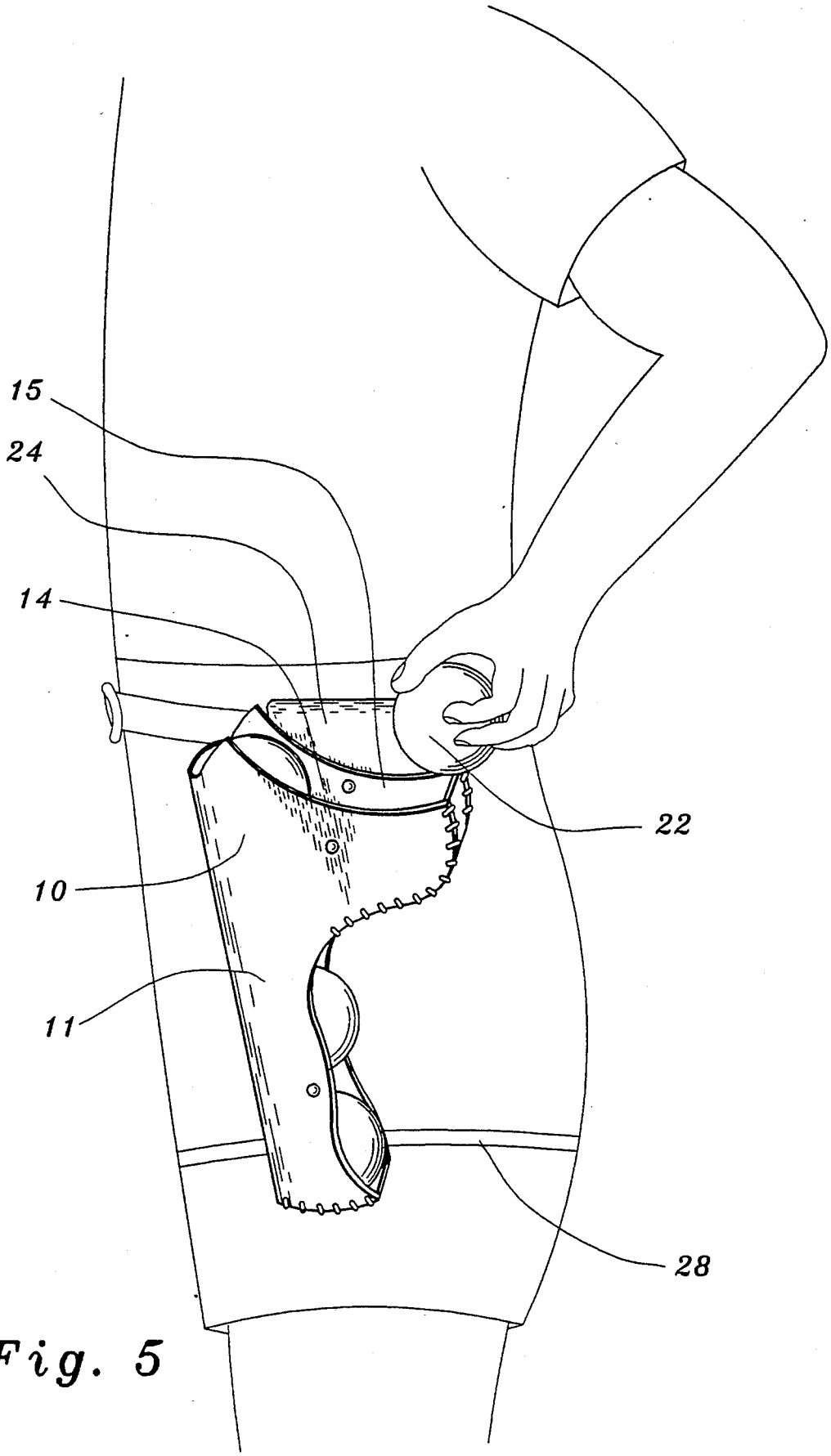
FIG. 5 through 7 are side views of a player wearing and using the holster of this invention.
Figure 6:
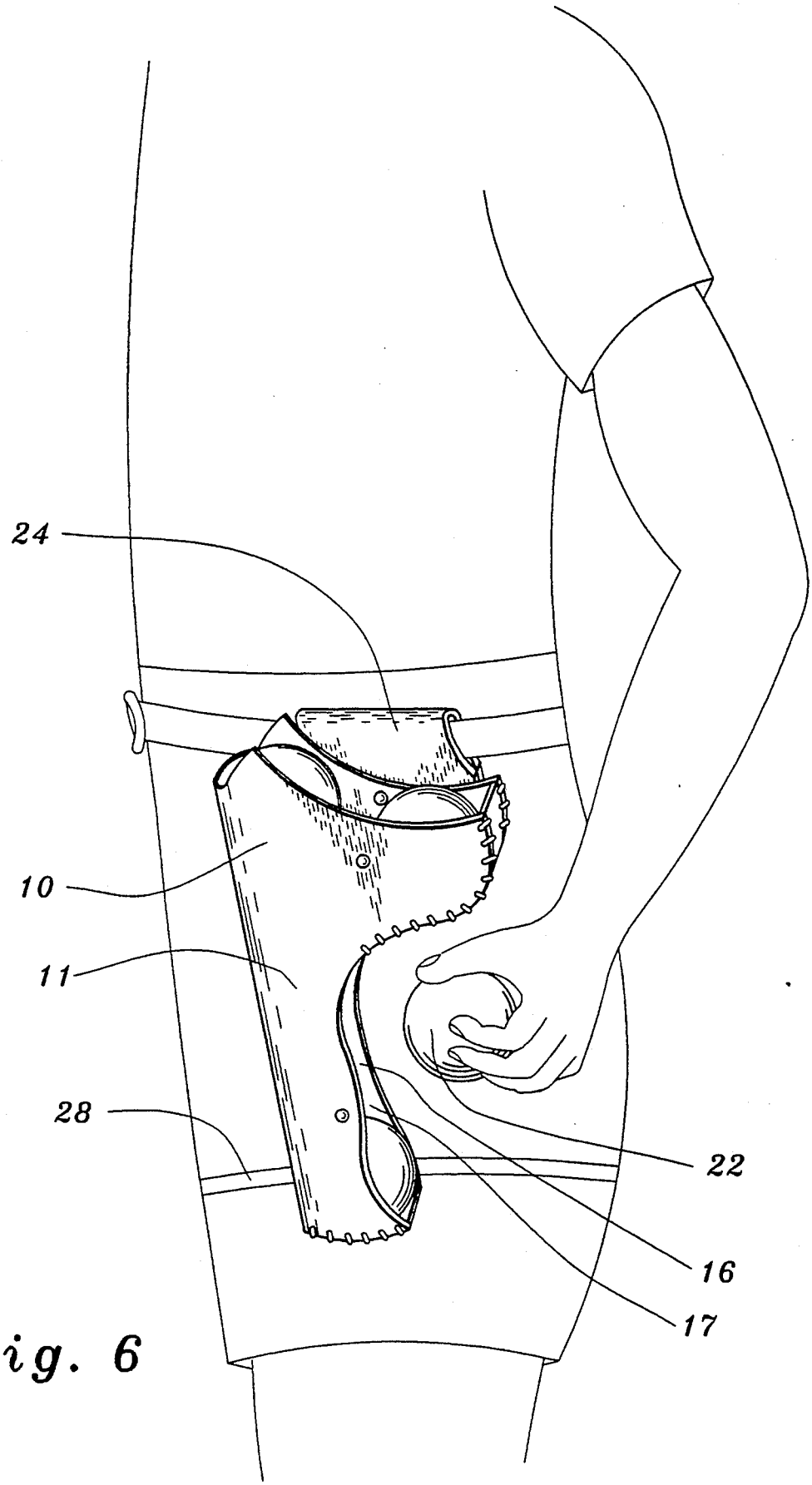
Figure 7:
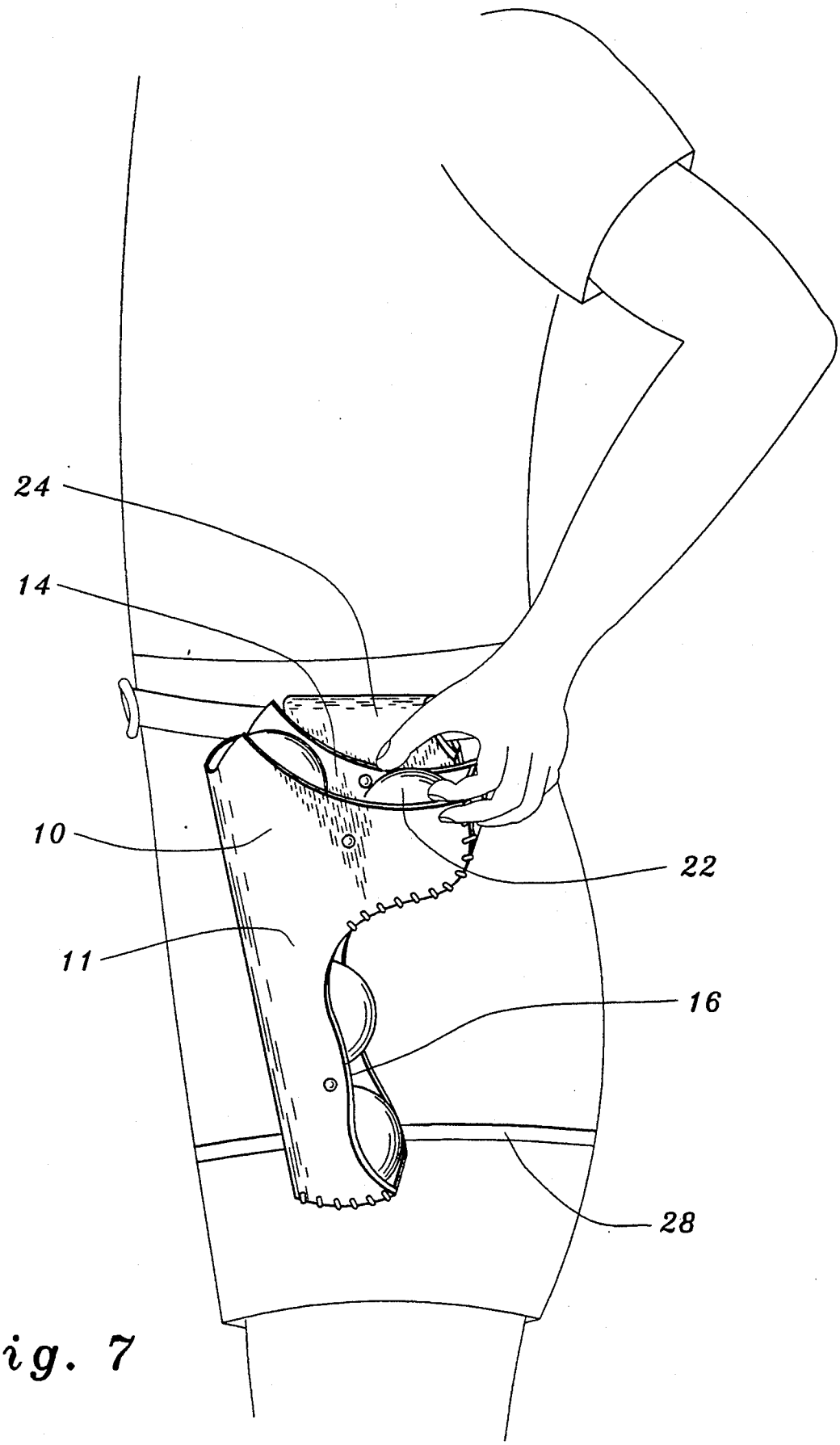

The ball holster 10 is supported on the belt of the wearer as shown in FIGS. 5 through 7 by a belt loop assembly 24 produced from a piece of leather or leather like material like that of the body 11. In FIG. 2 the belt loop assembly 24 is shown as including a belt loop liner 25, produced from a piece of leather or leather like material similar to the body 11, to simply add strength to the assembly. The belt loop assembly 24 is of a type which is folded back down upon itself defining a belt loop 26 between the fold as seen in FIG. 3. The belt loop assembly 24 is secured to the inner face 11D on the upper portion of the body 11 as seen in FIGS. 1 and 3. A belt loop assembly that was an integral part of the holster body could be used for support on a belt, but the belt loop assembly as described in the preferred embodiment will give added strength to the body 11 and make a more durable ball holster.

As shown in FIGS. 2 and 3, a leg strap loop 27 produced from a piece of leather or leather like material is secured as by riveting to the inner face 11D at the bottom of the body 11 to accept a leg strap 28. The leg strap 28 shown only in FIGS. 5 through 7 is produced from a piece of cotton and polyester material to allow washing and added comfort when worn. The leg strap 28 is inserted through the leg strap loop 27 then tied to the player's leg.

The belt loop assembly 24 combined with the leg strap 28 provide a means for the ball holster 10 to be secured to a belt and leg of the player.

Figure 4:
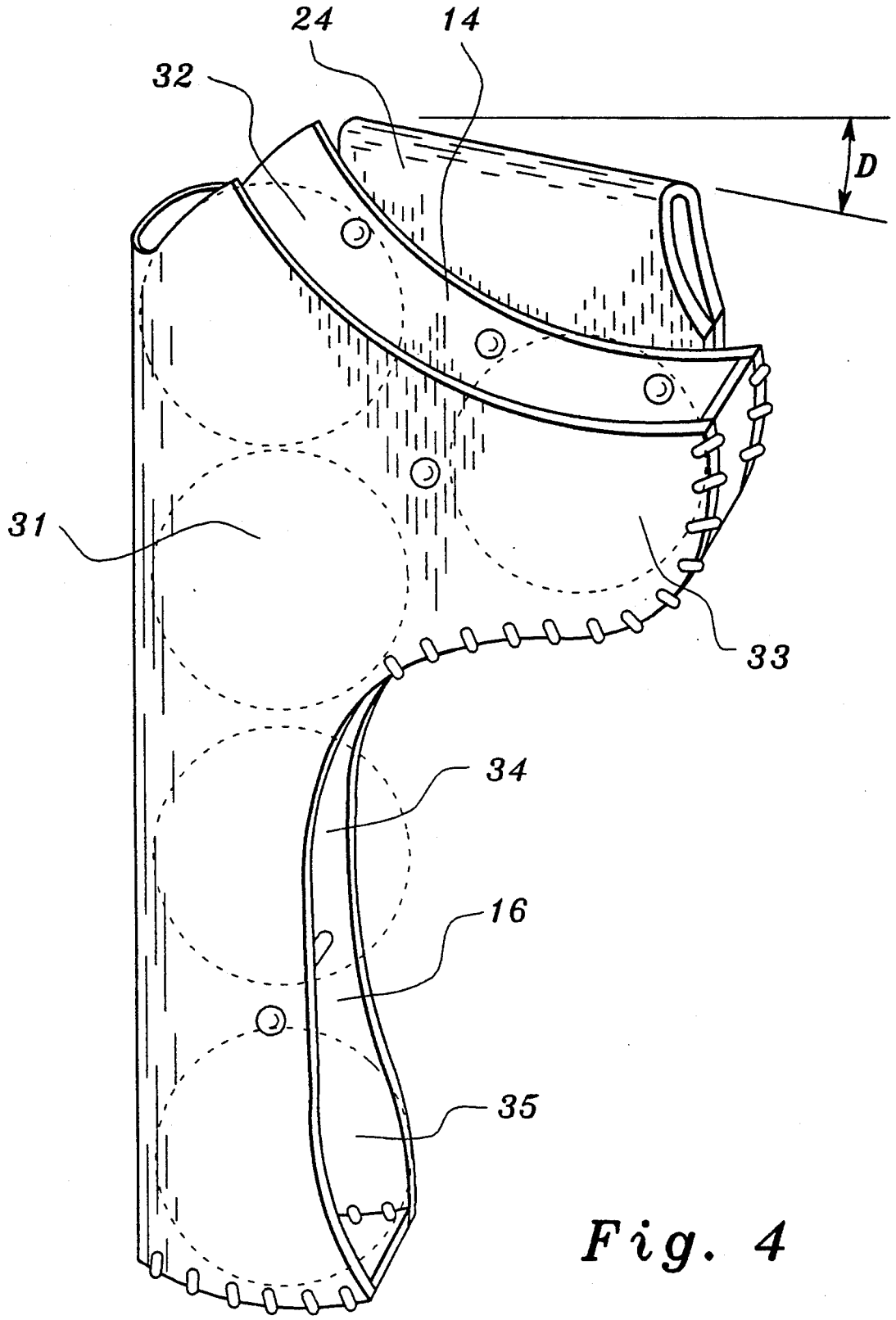
FIG. 4 is the same view as FIG. 1 but showing the balls by using dashed lines.

As shown in FIG. 4, the belt loop assembly 24 is designed with a drop D of 10 degrees from front to back to give the ball holster 10 a slight tilt when supported on the belt of the player as seen in FIGS. 5 through 7. This will allow easier access to the balls in the lower ball recess 16.

FIG. 4 also shows the positioning of the balls in their respective ball recess by using dashed lines to represent the balls. The upper ball recess 14 will accept three balls. Ball 31 should be inserted first followed by either ball 32 or ball 33. Upon removal ball 32 and ball 33 must be removed before ball 31 can be removed.

The lower ball recess 16 will accept two balls. Ball 34 and ball 35 can be inserted in any order but upon removal, it was found to be easier to remove ball 34 first and then ball 35.

The ball holster 10 may be seen in use by a player in FIGS. 5 through 7. In FIG. 5 the player is shown wearing the holster on the left hip area, for the right handed player, and inserting a ball 22 through the top opening 15 into the upper ball recess 14. The index finger and thumb can be used to hold the ball 22, pushing it through the top opening 15 where the body 11 will conform to the shape of the ball 22. Pushing the ball further into the upper ball recess 14 will allow contact with the hooked fastening material 20, but not shown in FIG. 5, retaining the ball in the holster.

In FIG. 6, the player can be seen inserting a ball 22 through the rear opening 17 into the lower ball recess 16. The method of ball insertion into the lower ball recess 16 is generally the same as previously described for the upper ball recess 14, but substituting lower ball recess 16 and rear opening 17 for upper ball recess 14 and top opening 15.

FIG. 7 shows the player starting to remove a ball 22 from the upper ball recess 14. Using the thumb to apply an outward pressure on the ball 22 will cause the ball to disengage from the body 11 allowing the player to put the ball in play. Referring back to FIG. 4, after ball 33 and ball 34 have been removed from the upper ball recess 14, the index and second finger, not shown in the drawing, may be inserted into the recess under the spacer 18 then under ball 32 pushing upward until it reaches the previous position of ball 33 where the thumb can apply outward pressure releasing ball 32 from the holster. Removal of the balls from the lower ball recess 16 would require outward pressure of the thumb but not shown in the drawing.

For a fuller understanding of the assembly and the various elements of the device, please refer to FIG. 2. The body liner 21 may be seen as exploded from the body 11. Before the body liner 21 is secured to the body 11, the hooked fastening material 20 should be attached to the body liner 21 as by cementing and then may be sewn to assure years of reliable service. The body liner 21, which is a mirror image of the body 11, may then be attached to the body 11 as by cementing. This will allow the stitching S for the hooked fastening material 20 on the body liner 21 to be hidden and not disturb the overall aesthetic features of the ball holster.

To accommodate five balls, the body has pre-fold dimensions, but not shown in the drawings, of 12⅞ inches across the widest part of what will be the upper ball recess, 5½ inches across the center of what will be the lower ball recess, and 6⅞ inches across the bottom of the body. From top to bottom the body measures $10\frac{7}{8}$ inches. The bottom panel is $2\frac{3}{8}$ inches long.

Still with FIG. 2, the belt loop liner 25, which is a mirror image of the belt loop assembly 24, may be attached to the belt loop assembly 24 as by cementing.

The divider panel liner 23 is $1\frac{1}{2}$ inches shorter than the $8\frac{1}{4}$ inch long divider panel 13 on the tapered end that attaches inside the body 11 behind the front fold 12. Otherwise, the divider panel liner 23 is a mirror image of the divider panel 13 and the two may be secured together by cementing. The shorter divider panel liner 23 will provide a single thickness of material at the end of the divider panel 13 to allow conformation to the shape of front fold 12.

After front fold 12 is accomplished, the body 11 and the divider panel 13 may be laced together generally in the lace pattern shown in FIG. 1, using lacing L produced from leather material. The divider panel is laced around the edges of the outer face 11C and inner face 11D along the rear upper portion 11A of the body 11. The tapered end of the divider panel 13 can then be cemented inside the holster body behind front fold 12 as seen in FIG. 3.

The bottom panel 11B is folded to meet the bottom edges of the body 11 and then may be laced together generally in the lace pattern shown on FIG. 1.

Back to FIG. 2, before the belt loop assembly 24 is folded, it is attached to the inner face 11D on the upper portion of the holster body 11. This is accomplished by a first set of three fasteners 29 and 29A, such as rivets, which are shown exploded and numbered separate in the drawing. The stud parts of the rivets, fasteners 29, are inserted through corresponding holes in the belt loop assembly 24 and body 11 where the cap part of the rivets, fasteners 29A, are inserted from inside the body 11 onto fasteners 29 securing the general middle part of the belt loop assembly 24 thereof. The belt loop assembly 24 is then folded down upon itself and secured by a second set of fasteners 30 and 30A, such as rivets, which are shown exploded and numbered separate in FIG. 2. The stud part of the rivets, fasteners 30, are inserted through corresponding holes in the folded down end of the belt loop assembly 24 through the part of the belt loop assembly 24 which has been secured to the body 11 then through the body 11. The cap part of the rivets, fasteners 30A, are inserted from inside the body 11 onto fasteners 30 completing the joining of the belt loop assembly 24 to the body 11.

With the elements, divider panel 13, bottom panel 11B, and belt loop assembly 24, secured to the body 11 the basis for the present invention is formed.

Referring to FIGS. 1, 2, and 3, in the upper ball recess 14 the spacer 18 should be $1\frac{1}{2}$ inches below the top opening 15 and $2\frac{3}{4}$ inches to the rear of the front fold 12.

The spacer 19 in the lower ball recess 16 is located $\frac{1}{2}$ inch in front of the rear opening 17 and 3 inches above the bottom of the body 11.

Holes corresponding to the above mentioned measurements are provided in the body 11. The holes in the outer face 11C need to be of sufficient size to allow insertion of spacer 18 and 19. Holes in the inner face will be smaller to allow only the mating screws 18A and 19A to pass through the body 11. In the preferred embodiment, 11/64" holes were needed to accept the spacer 18 and 19 and $\frac{1}{8}$" holes were needed to accept the mating screws 18A and 19A.

The spacer 18 is inserted through the outer face 11C across the upper ball recess 14 until it touches the body liner 21. A $3/16'' \times \frac{3}{4}''$ mating screw 18A is inserted through holes 18B in the belt loop assembly 24, through corresponding holes in the inner face 11D of the body 11 where it is secured to the spacer 18.

In the lower ball recess 16, the spacer 19 is inserted through the outer face 11C across the lower ball recess 16 until it touches the body liner 21. A $3/16'' \times \frac{3}{8}''$ mating screw 19A is inserted through the inner face 11D of the body 11 where it is secured to spacer 19.

Installation of the hooked fastening material 20 should be at the approximate point where the ball 22, not shown in FIG. 2 or 3, touches the sides of the respective ball recess when the ball is fully inserted.

The elements of the body 11 working with the divider panel 13, bottom panel 11B, belt loop assembly 24, spacers 18, 19, and hooked fastening material 20, form the present invention which has been 100% effective. During testing of the ball holster 10, not a single ball independently fell from the holster.

Given the combination above, I have produced a ball carrying device defining an upper ball recess with a top opening and lower ball recess with a rear opening for the storage and removal of balls, particularly tennis balls. The ball holster of the present invention provides a reliable and durable ball carrying device which can be easily manufactured. It further provides mounting to the player which will not restrict body movement and allow greater physical and visual access than previous ball carrying devices. The unique design and enticing appearance of the present invention provides a ball carrying device which can end the limited product availability in this area.

The foregoing constitutes a disclosure of the best mode known to me for carrying out this invention.

While my above description contains many specificities, this should not be construed as limiting the scope of the invention, but rather as an exemplification of one preferred embodiment thereof. Other variations are possible. For example, the ball carrying device in the above embodiment is for the right handed player. A ball carrying device for the left handed player would be necessary and has been produced using the same elements and similar methods. The spacer in FIGS. 1 through 3 could be made from other materials of various shapes but producing the same results as the spacer in the embodiment. The divider panel and bottom panel in FIGS. 1 through 3 could be secured to the body by sewing and a welt could be added between each panel and the body. For someone skilled in the art, the present invention could be made of plastic molded to shape a ball carrying device like that in the preferred embodiment.

Accordingly the scope of this invention should be determined not by the embodiment illustrated but by the following claims and their legal equivalents.

What I claim is:

1. A ball carrying device for the storage and removal of balls comprising:

a body of material of sufficient size to accommodate a plurality of balls formed into a U-shape with a front fold;

means for securing said body to the player;

said body being closed along a rear upper portion by a divider panel; said divider panel extending inside said body and joined behind said front fold dividing said body into a upper ball recess with a top opening and a lower ball recess with a rear opening to allow insertion and removal of balls from the top and rear;

said lower ball recess is closed on the bottom by securing a bottom panel;

a first spacer to adjust the center of said upper ball recess to a dimension slightly less than a diameter of a ball to allow said body to conform to the ball upon insertion and removal;

a second spacer to adjust the center of said lower ball recess to a dimension slightly less than a diameter of a ball to allow said body to conform to the ball upon insertion and removal;

a plurality of a hooked fastening means for retaining the majority of balls in said upper ball recess and each ball in said lower ball recess by being secured at a point where the respective ball touches the sides of said upper ball recess and said lower ball recess.

2. The ball carrying device of claim 1 wherein said material is made of leather.

3. The invention of claim 1 wherein said means to secure said body to a player includes a belt loop assembly.

4. The invention of claim 3 further including a leg strap loop.

* * * * *